US006149742A

United States Patent [19]

Carpenter et al.

[11] Patent Number: 6,149,742

[45] Date of Patent: Nov. 21, 2000

[54] PROCESS FOR CONDITIONING SHAPE MEMORY ALLOYS

[75] Inventors: Bernie F. Carpenter; Jerry L. Draper, both of Littleton, Colo.

[73] Assignee: Lockheed Martin Corporation, Bethesda, Md.

[21] Appl. No.: 09/084,686

[22] Filed: May 26, 1998

[51] Int. Cl.[7] ..... C21D 10/00

[52] U.S. Cl. ..... 148/563; 337/139; 337/140

[58] Field of Search ..... 148/563, 402; 420/902; 337/139, 140

[56] References Cited

U.S. PATENT DOCUMENTS

| | | | |
|---|---|---|---|
| 3,558,369 | 1/1971 | Wang et al. | 148/11.5 |
| 3,700,434 | 10/1972 | Abkowitz et al. | 75/214 |
| 4,144,057 | 3/1979 | Melton et al. | 75/134 C |
| 4,283,233 | 8/1981 | Goldstein et al. | 148/11.5 R |
| 4,304,613 | 12/1981 | Wang et al. | 148/11.5 N |
| 4,386,971 | 6/1983 | Melton et al. | 148/11.5 R |
| 4,404,025 | 9/1983 | Mercier et al. | 148/11.5 F |
| 4,405,387 | 9/1983 | Albrecht et al. | 148/11.5 R |
| 4,411,711 | 10/1983 | Albrecht et al. | 148/11.5 A |
| 4,412,872 | 11/1983 | Albrecht et al. | 148/11.5 F |
| 4,416,706 | 11/1983 | Albrecht et al. | 148/11.5 C |
| 4,435,229 | 3/1984 | Johnson | 148/11.5 R |
| 4,484,955 | 11/1984 | Hochstein | 148/11.5 R |
| 4,502,896 | 3/1985 | Duerig et al. | 148/11.5 F |
| 4,518,444 | 5/1985 | Albrecht et al. | 148/402 |
| 4,533,411 | 8/1985 | Melton | 148/402 |
| 4,631,094 | 12/1986 | Simpson et al. | 148/11.5 F |
| 4,637,962 | 1/1987 | Albrecht et al. | 428/616 |
| 4,740,253 | 4/1988 | Simpson et al. | 148/11.5 R |
| 4,770,725 | 9/1988 | Simpson et al. | 148/402 |
| 4,780,154 | 10/1988 | Mori et al. | 148/12.1 |
| 4,808,246 | 2/1989 | Albrecht et al. | 148/11.5 Q |
| 4,878,954 | 11/1989 | Dubertret et al. | 148/11.5 F |
| 4,881,981 | 11/1989 | Thoma et al. | 148/11.5 R |
| 4,894,100 | 1/1990 | Yamauchi et al. | 148/402 |
| 4,935,068 | 6/1990 | Duerig | 148/11.5 C |
| 4,943,326 | 7/1990 | Ozawa et al. | 148/402 |
| 5,032,195 | 7/1991 | Shin et al. | 148/402 |
| 5,066,341 | 11/1991 | Grenouillet | 148/11.5 C |
| 5,173,131 | 12/1992 | Mantel | 148/402 |
| 5,226,979 | 7/1993 | Thoma | 148/402 |
| 5,419,788 | 5/1995 | Thoma et al. | 148/402 |

OTHER PUBLICATIONS

"Using Shape Memory Alloys", 1998 Shape Memory Applications, Inc., Darel Hodgson, Ph.D, pp. 1–37, 1988.

*Primary Examiner*—Sikyin Ip

*Attorney, Agent, or Firm*—Marsh Fischmann & Breyfogle LLP

[57] ABSTRACT

A process for conditioning shape memory alloys is disclosed. The process preferably includes force application/release cycling of a shape memory alloy at a temperature above the martensitic-austenitic transformation ($A_f$) finish temperature of the alloy, but below the maximum temperature at which an austenitic-martensitic transformation will be effected by the force application. The alloy is preferably cold-worked and annealed prior to force application/release cycling. The invention yields greater control over martensitic-austenitic and austenitic-martensitic transformation temperatures and yields reduced hysteresis variability. In certain disclosed embodiments a TiNi or CuAl containing alloy may be cold-worked between about 20% and 45%, and annealed to maintain between about 3% and 8% of the cold working. The alloy may then be heated to between about $A_f$ and 5° C. and $A_f$15° C. and conditioned via the application/release of a force for at least about 50 cycles, wherein an austenitic-martensitic phase transformation is induced. The conditioned alloy may then be cooled and integrated into an application mechanism for subsequent selective activation upon heating.

33 Claims, 10 Drawing Sheets

PROCESS FOR CONDITIONING SHAPE MEMORY ALLOYS

FIELD OF THE INVENTION

The present invention relates to the processing of metal alloys, and in particular to the conditioning of shape memory alloys in a manner that enhances the use of such alloys in high-precision applications (e.g., actuators for spacecraft, aircraft and/or underwater applications).

BACKGROUND OF THE INVENTION

Generally, shape memory alloys are metal alloys that may be deformed to a "set" shape and otherwise conditioned during processing in such a manner that they may be selectively "actuated" during use to revert or attempt to revert to their pre-deformation shape. In other words, shape memory alloys can "remember" their pre-deformation shape and be selectively activated to move positionally or apply pressure (e.g., to another object), thereby rendering shape memory alloys attractive for actuator and other like applications. To date, proposed shape memory alloys have most typically been thermomechanically conditioned with the alloy starting at least partially in a martensitic state and with thermal cycling driving any phase transformation(s) occurring during conditioning.

Actuation of shape memory alloys is achieved by heating a conditioned alloy to at least a corresponding martensitic-austenitic transformation temperature (e.g., wherein needle-like crystals present in the martensite phase transform to more equi-dimensional crystals characterizing the austenite phase). In this regard, the transformation from a martensitic state to an austenitic state occurs over a range of temperatures, with the "starting" austenitic temperature ($A_s$) being the temperature at which an austenitic phase for the basic alloy begins to form and coexist with a martensitic phase. The "finish" austenitic temperature ($A_f$) is the temperature at which the basic alloy is substantially in its austenitic phase. Upon cooling, the basic alloy will change from the austenitic state back to a martensitic state, with the austenitic-martensitic phase transformation also occurring over a range of temperatures. As will be appreciated, the "starting" martensitic temperature ($M_s$), (i.e., where the martensite phase in the basic alloy begins to form and coexist with the austenite phase), and the "finishing" martensitic temperature ($M_f$), (i.e., where the basic alloy substantially comprises the martensitic phase) are both lower than the starting austenitic $A_s$ temperature.

The martensitic-austenitic and austenitic-martensitic phase transformation temperature ranges for shape memory alloys vary widely by alloy type/composition and can be varied by alloy conditioning. In this regard, transformation temperatures have been observed as low as about −60° C. and as high as several hundred degrees C. Such a range of transformation temperatures facilitates the potential use of shape memory alloys in a variety of actuator and other like applications.

To date, however, shape memory alloys have not been widely employed in high-precision applications due to reliability and control issues. More particularly, known shape memory alloys display significant hysteresis variability in repeated or cyclic actuations. In this regard, for spacecraft and other applications, it is typically important for actuator devices to respond in "ground-based" testing in a manner which supports a high degree of confidence that the same response will be repeated during actual use. Further, many known shape memory alloys exhibit a relatively wide range in phase transformation temperatures, thereby making it difficult to precisely control actuation.

SUMMARY OF THE INVENTION

In view of the foregoing, a broad object of the present invention is to provide for the improved processing of shape metal alloys, including improved conditioning so as to enhance various properties desirable for high-precision actuator and other like applications.

More particularly, it is an object of the present invention to provide for the improved conditioning of shape memory alloys such that hysteresis variability between repeated actuations is reduced. It is another specific object of the present invention to provide for improved shape memory alloy processing, wherein martensitic-austenitic and austenitic-martensitic phase transformation temperatures are highly predictable, thereby facilitating enhanced control over the selective initiation and degree of actuation in use.

One or more of the above objectives and additional related advantages may be realized by the present inventive process which includes the steps of deforming a shape memory alloy from a pre-deformation shape to a deformed, or "set," shape (e.g., via strain, stress and/or torsional force application), followed by pseudoelastic conditioning the alloy at an elevated temperature T. Of importance, T should be greater than the finish martensitic-austenitic transformation temperature ($A_f$) for the given alloy and less than the maximum temperature ($M_d$) at which an austenitic-martensitic phase transformation can be induced by the application of force (e.g., stress, strain and/or torsional). In this regard, the present inventors have recognized the desirability of pseudoelastically conditioning, or "training" shape memory alloys (i.e., via the application of stress, strain and/or torsional forces) at a temperature T, wherein $M_d>T>A_f$, and wherein austenitic-martensitic phase transformation during conditioning is driven by an applied force. For most shape memory alloys of interest (e.g., TiNi and CuAl containing alloys), T should be preferably between about $A_f$ and about $A_f$+20° C., and most preferably between about $A_f$+5° C. and about $A_f$+15° C. Further, it is also believed preferable to maintain T at substantially constant temperature (e.g., within ±5° C. during training to define substantially isothermal training conditions).

As will be appreciated, upon heating shape memory alloy for conditioning in the present invention the alloy will be actuated to revert or attempt to revert from its deformed shape it to its predeformation shape. In this regard, conditioning will preferably comprise the cyclic application/release of a strain, stress and/or torsional training force to pseudoelastically deflect or deform the shape memory alloy and thereby enhance the "training" of the actuated alloy. Further, force application during training should at least partially "mimic" the force application of the deforming step. Even more preferably, only a limited portion or degree of the forced deformation occurring during the deforming step (i.e., in deforming the alloy from a predeformed shape to a deformed shape) should be cyclically repeated, or imitated, during the conditioning step. In any case, the degree of cyclic deformation or deflection imparted during conditioning should preferably not exceed the pseudoelastic limit for a given shape memory alloy (i.e. the alloy should substantially return to its initial, predeformation shape upon force release during conditioning). Concomitantly, such limit on the degree of deformation should also preferably be observed during the initial deforming step.

Shape memory alloys that are particularly apt for use in the present invention include those comprising nickel and titanium (e.g., as the binary or base alloys), and those comprising copper and aluminum (e.g., as base alloys). By way of primary example, shape memory alloys that may be utilized in the present invention may be selected from a group comprising: NiTi, NiTiCu, CuZnAl, CuAlNi, NiTiFe, CuAlNiTiMn, TiNiPd, and TiNiPt.

In one aspect, the inventive process may comprise the step of cold-working the metal alloy prior to the deforming and conditioning steps. In this regard, cold-working the alloy provides energy which can be utilized to effect a desired mechanical response upon actuation of the alloy during use, as will be further described. Preferably, the degree of cold-working should be between about 20% and 45%, and most preferably about 30%. In any case, the alloy should preferably display between about 3% and about 8% cold-working prior to the conditioning step.

In another aspect, the inventive process may further comprise annealing a cold-worked alloy prior to the conditioning step. Of importance, at least about 3%, and most preferably between about 3% and about 8% of the cold-working should be maintained in the alloy so as to preserve sufficient energy for the desired mechanical response upon actuation. Annealing of the alloy may also be utilized to increase transformation temperatures, and to increase the "sharpness" of martensite-austenite and austenite-martensite transformation temperature ranges (e.g., thereby enhancing actuation control capabilities). In the later regard, and by way of particular example, it has been determined that for many shape memory alloys of interest (e.g., TiNi and CuAl containing alloys), the annealing temperature may be advantageously set at between about 400° C. and 500° C., and most preferably between about 425° C. and 475° C.

In yet another aspect, the inventive process may comprise successively repeating the above-noted application/release of force in the conditioning step for at least about 50 cycles, and even more preferably for at least about 300 cycles. In this regard, the present inventors have found that as the number of force application/release cycles increases, while maintaining the conditioning temperature T at $M_d>T>A_f$, the applied force-induced austenite-martensite boundary of a shape memory alloy will decrease while the force-induced martensite-austenite boundary will remain relatively constant. As such, hysteresis variability in repeated actuations (i.e., during use) may be reduced. It is believed that the noted reduction in the force-induced martensite boundary results in the formation of defects during cycling which assists in the formation of preferred martensitic variants. Relatedly, because only one austenitic orientation is present, the reversion from aligned martensite to austenite is not greatly affected by micro-structural effects induced by the applied force cycling and the resulting boundary force remains relatively constant.

As indicated, the shape memory alloy deflection (e.g., elongation, bending and/or twisting) effected by force application during the conditioning step of the present invention should not exceed the pseudoelastic limit of the alloy and should mimic the shape memory alloy deformation (e.g., as elongated, bent or twisted) during the deforming step. That is, for example, the force type (e.g., strain stress and/or torsional) and orientation or direction of force application (e.g., along a defined axis, within a defined plane, within a defined range of motion, etc.) should be substantially the same. Further, the degree to which force is applied and the related extent to which deflection is effected during conditioning should preferably not exceed, and for some applications, should preferably be less than the degree and related extent realized during the deforming step. For example, if an axial tensile force is applied to effect an 8% strain in a shape memory alloy wire during a deforming step, a like-oriented tensile force should be utilized during the conditioning step to effect no more than, and even more preferably less than, 8% strain in the shape memory alloy.

In a further related aspect of the present invention, it has been found that proper selection of the annealing temperature in the above-noted annealing step can serve to selectively reduce the evolution of permanent set induced during force application/release cycling, as may be desired for many applications (e.g., control surface applications where heat flow to/from a shape memory actuator is regulated to obtain a desired, incremental displacement). More particularly, for many shape memory alloys of interest (e.g., TiNi and CuAl containing alloys), the annealing temperature should be less than about 475° C., and most preferably between about 425° C. and 450° C. to reduce permanent set (e.g., to about 1% or less). Additionally, to further reduce the evolution of permanent set during force application cycling, it has been found desirable to select a temperature T (i.e., for the conditioning step) that is less than about $A_f$+20° C., and more preferably between about $A_f$+5° C. and $A_f$+15° C.

Numerous additional extensions and advantages of the present invention will become apparent upon consideration of the further description that follows.

DETAILED DESCRIPTION

One embodiment of the present invention for processing and improving the conditioning of shape memory alloys is described hereinbelow. The embodiment yields enhanced conditioned-alloy properties, including inter alia, reduced hysteresis variability and a sharper martensitic-austenitic and austenitic-martensitic transformation temperature ranges.

Figure 1:
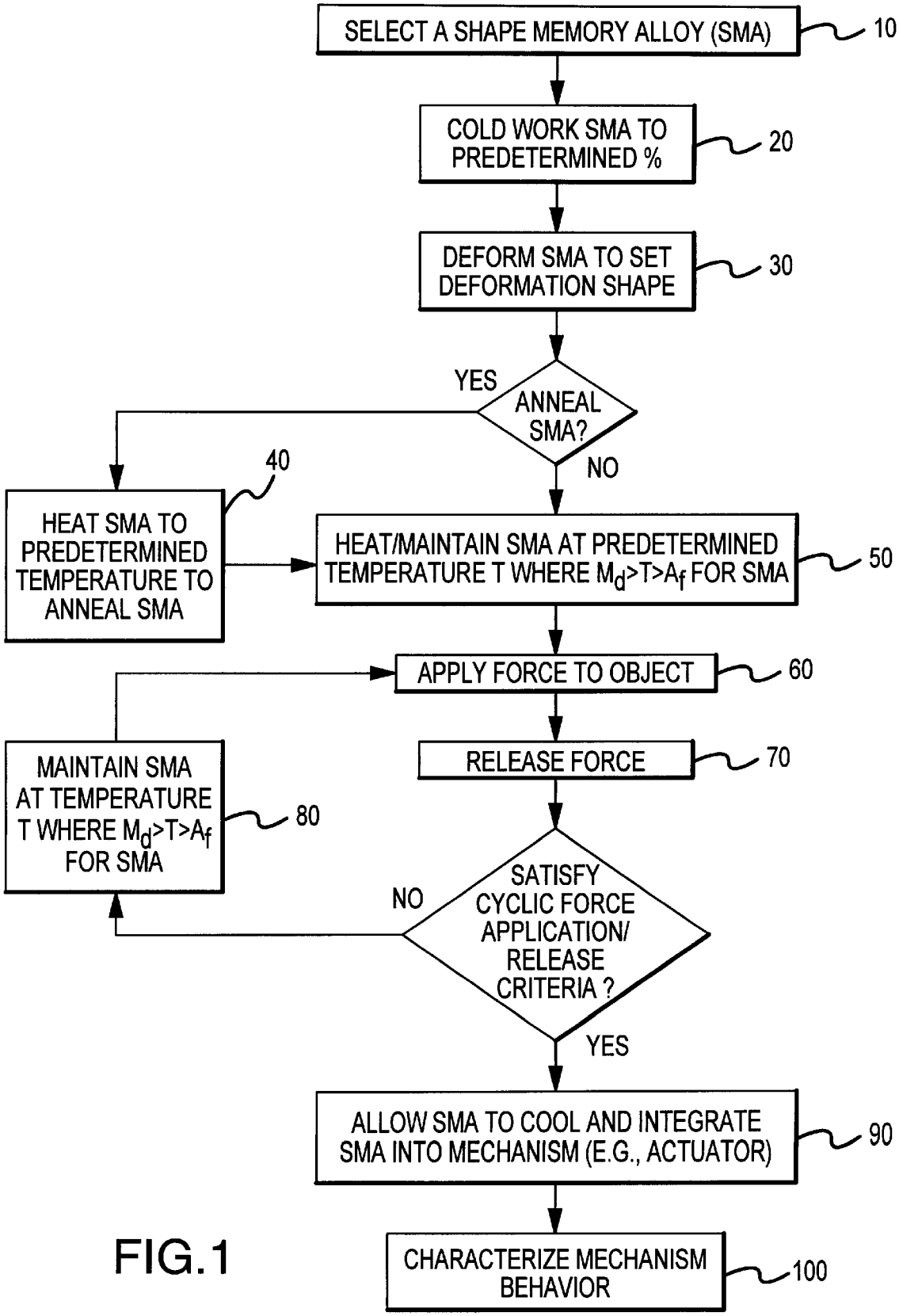
FIG. 1 is a flow chart showing one process embodiment of the present invention.

As illustrated in FIG. 1, the process embodiment includes the selection of a shape memory alloy (SMA) as may be appropriate for a given application (step 10), cold-working such SMA to a predetermined percentage (step 20), and deforming the cold-worked SMA to "set" a deformation shape (step 30). As will be appreciated, fabrication of the SMA into a desired configuration (e.g., an actuator mechanism) may be totally or partially completed in conjunction with step 30 and/or may be carried out later in the process. The process may further include annealing the cold-worked, deformed SMA by heating the SMA to a predetermined annealing temperature for a predetermined period of time (step 40).

The conditioning process further comprises the conditioning steps of: i) heating the SMA to a predetermined temperature T that is greater than the finish temperature $A_f$ at which martensitic-austenitic transformation is complete for the selected SMA yet less than the maximum temperature ($M_d$) at which an austenitic-martensitic phase transformation will be induced by force application/release (step 50), and ii) applying and releasing a strain and/or stress and/or torsional force to pseudoelastically deflect the SMA (steps 60 and 70), while maintaining the SMA at the elevated temperature T. The force applied during conditioning should be sufficient to induce an austenitic-martensitic phase transformation. Further, force application/release (steps 60 and 70) may be advantageously repeated a predetermined number of cycle times while maintaining the SMA at the elevated temperature T (step 80). Upon satisfaction of the cyclic criteria for a given SMA, the conditioned SMA may then be coded and integrated into the intended application mechanism (step 90), e.a., an actuator as per FIG. 1 and subsequently tested to establish particular performance characteristics (step 100). In this regard, the conditioning process of the illustrated embodiment yields a shape memory alloy that is particularly apt for use in high precision actuators, including actuators for use in spacecraft, aircraft and underwater applications where reliable performance is at a premium.

Figure 2:
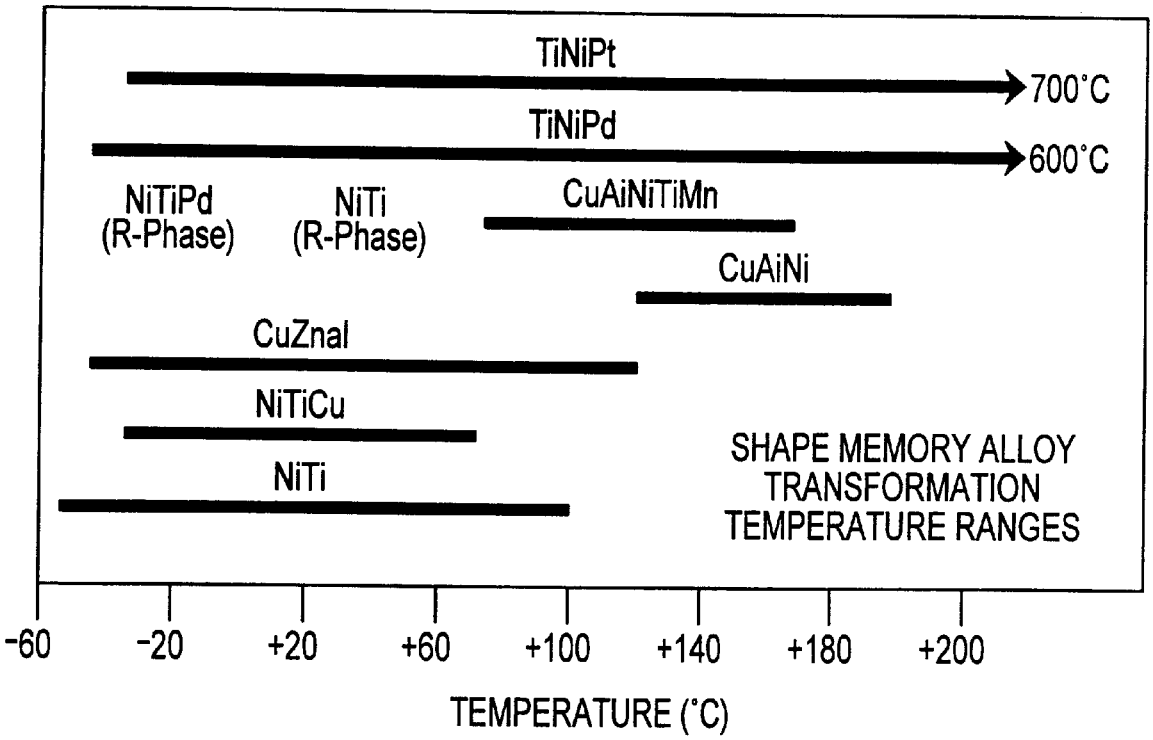
FIG. 2 is a bar graph showing phase transformation temperatures for representative shape memory alloys suitable for use in the process of the present invention.

With particular respect to step 10, suitable shape memory alloys that may be selected for the conditioning process of the present invention include nickel-titanium based alloys and copper-aluminum based alloys, either of which may be doped with a transition metal. Preferably, NiTi-containing alloys will comprise between about 52% and 56% Ni by weight, and between about 44% and 48% Ti by weight. Analogously, CuAl-containing alloys will comprise at least about 50% Cu by weight, and between about 4% and 8% Al by weight. Known specific alloys that may be utilized include the following: NiTi, NiTiCu, CuZnAl, CuAlNi, R-phase NiTiFe, R-phase NiTi, CuAlNiTiMn, TiNiPd, TiNiPt, NiTiPd, and TiNiHf. In this regard, it will be appreciated that, each alloy employable with the present invention will have a different phase transformation temperature range (e.g., such range comprising $M_s$, $M_f$, $A_s$ and $A_f$ for the alloy), as demonstrated by the selected alloys shown in FIG. 2. Thus, an alloy composition can be selected to accommodate the desired phase transformation temperatures and actuator response capabilities for each given application.

In further reference to the cold-working step 20, it is noted that the selected SMA should be cold-worked in a martensitic state so as to deform the structure of individual crystals, thereby providing the necessary "stored" energy to the SMA for response upon actuation. By way of example, the cold-working step may comprise rolling, stretching, or drawing the SMA. Preferably the degree of cold-working should be between about 25% and 45%, and most preferably about 30%. As will be appreciated, shape memory alloys may be readily obtainable from open market sources in a cold-worked condition.

With further regard to the deformation step 30, it is noted that the SMA should be deformed in a martensitic state. The deformation may be achieved by any suitable means for applying a strain, stress and/or torsional force, e.g., so as to yield the desired elongation, bending and/or twisting of the SMA.

As noted above, in the annealing step 40 the SMA may be heated to a predetermined annealing temperature. Such annealing temperature and a predetermined annealing time period should be selected so as to reduce the cold-working in the SMA to a predetermined percentage. Preferably, the annealing temperature and time should be selected so as to maintain between about 3% and about 8% of the prior cold-working. In this regard, for most shape memory alloys of interest (i.e., NiTi and CuAl containing alloys) an annealing temperature of between about 425° C. and 475° C., and an annealing time at least about 30 minutes may be employed.

In addition to reducing the degree of cold-working in the SMA, annealing the SMA can also serve to increase transformation temperatures as may be desirable for certain applications. Further, as noted previously herein, annealing can also serve to increase transformation sharpness for both the martensitic-austenitic and austenitic-martensitic transformation. In this regard, increased "sharpness" refers to reducing the difference between the initial and finish transformation temperatures. As will be appreciated, by decreasing the difference between $A_s$ and $A_f$, and between $M_s$ and $M_f$, control over phase transformations and subsequent actuation of the SMA object can be more tightly and selectively controlled. In this regard, it has been found that, for certain shape memory alloys of interest (e.g., NiTi-containing alloys) an annealing temperature of between 450° C. and 500° C. yields satisfactory results. Of further note, annealing can be utilized to reduce the degree of permanent set that may otherwise result from the cyclic repetition of the force application and release steps 60 and 70 during conditioning. In this regard, it has been found that, for certain shape memory alloys of interest (e.g., NiTi-containing alloys) an annealing temperature of between 425° C. and 475° C. yields satisfactory results.

With further regard to step 50 the SMA may be heated to the predetermined temperature T via submersion of the SMA in an isothermal bath. While in such bath, the force application and release steps 60 and 70 may be completed. In this regard, the applied force should be selected to pseudoelastically deflect the SMA in step 60. Similarly, the force should be released (step 70) in a controlled manner to ensure that pseudoelasticity is maintained (i.e., so that the SMA will substantially return to its initial predeformation shape upon force release). As previously noted, the force applied in step 60 should be the same nature (i.e., stress, strain and torsional) and direction/orientation as the force applied during the deforming step 30. Further, the degree or extent of deflection effected in step 60 should not exceed the degree or extent of deformation in the deforming step 30.

As noted, the applying and releasing steps 60 and 70 may be repeated for a number of cycles. In this regard, at least about 50 cycles, and most preferably at least about 300 cycles may be utilized. Such thermomechanical cycling decreases hysteresis variability associated with phase transformations. In this regard, it should be noted that although there is only one austenitic crystallographic orientation, there are several possible martensitic orientations. It is believed that thermomechanical cycling creates crystallographic defects which favor the formation of martensitic crystallographic variants. Thus, the austenite-martensite transformation is facilitated, and $M_s$ and $M_f$ decrease with increased cycling. At the same time, the microstructural effects induced by strain cycling do not greatly affect the reversion from aligned martensite to austenite, and $A_s$ and $A_f$ remain substantially constant.

With further regard to step 90, it should be appreciated that in certain applications batch processing of a shape memory alloy through steps 10 through 80 may be advantageously completed prior to the fabrication/integration of separate SMA components in step 90. For example, for SMA wire applications, steps 10–80 may be completed, followed by the cutting of SMA wire lengths and integration of such lengths into an actuator in step 90. Such batch processing may be used to yield significant production efficiencies.

Specific examples of various aspects of the present invention are set forth below.

EXAMPLE 1

Figure 3:
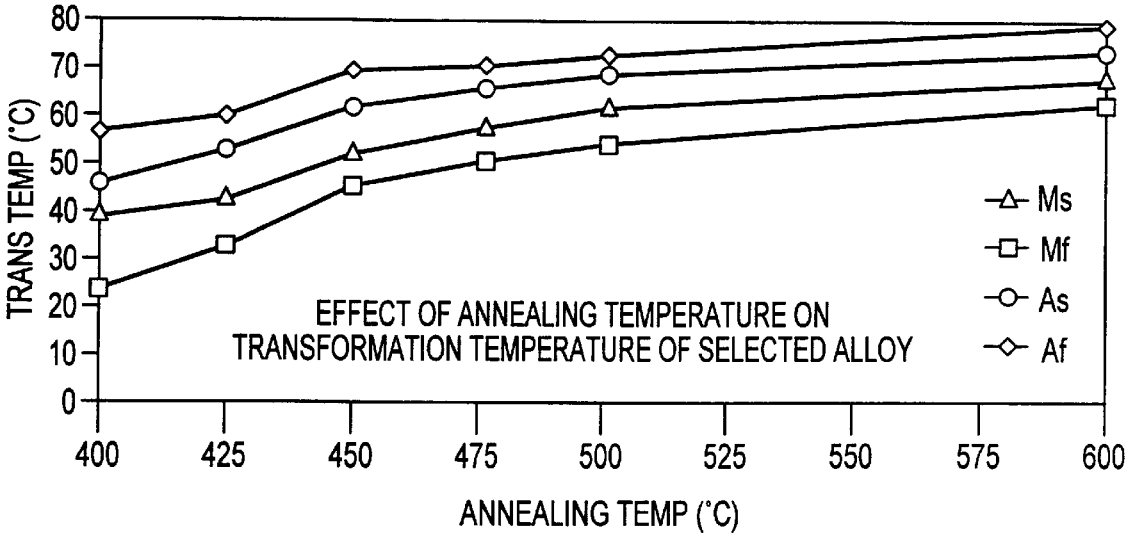
FIG. 3 is a graph showing the phase transformation temperatures $M_s$, $M_f$, $A_s$, and $A_f$ as a function of annealing temperature for 0.020-inch diameter NiTiCu wire annealed in accordance with the process of the present invention.

Samples of as-drawn 0.020-inch diameter NiTiCu wire with approximately 30% cold work were annealed at 400, 425, 450, 475, 500, and 600° C. for thirty minutes to determine the effects of annealing on phase transformation temperatures. As shown in FIG. 3, increasing the annealing temperature serves to increase $A_s$, $A_f$, $M_s$, and $M_f$. The rate of increase of the transformation temperatures, however, decreases with increasing annealing temperatures. These results are consistent reported recrystallization temperatures for NiTi alloys, wherein most of the recrystallization occurs at temperatures up to about 450° C.

Figure 4:
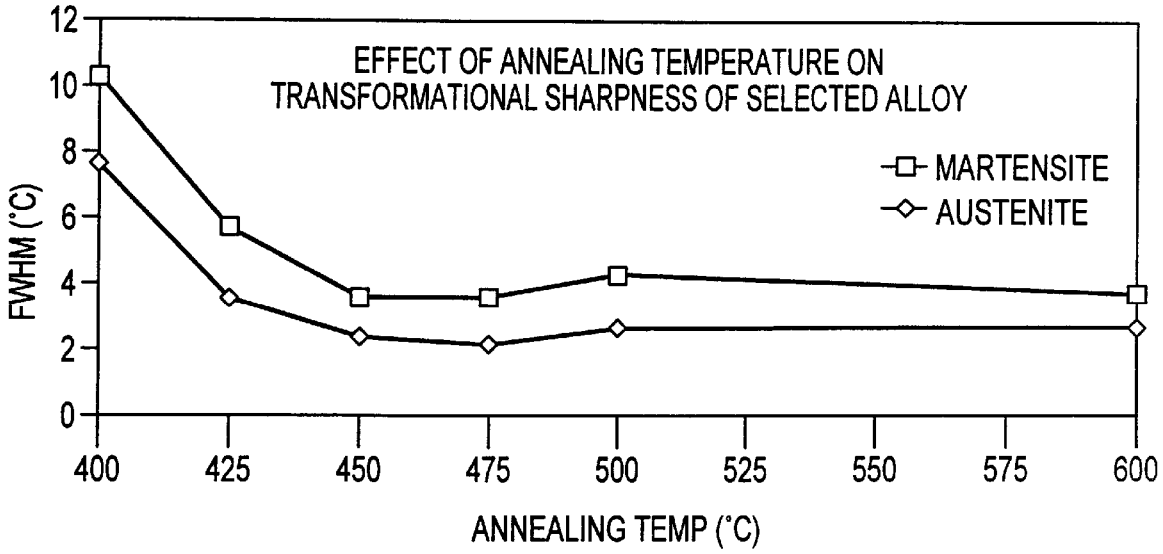
FIG. 4 is a graph showing the sharpness of martensitic-austenitic and austenitic-martensitic transformations as a function of annealing temperature for a 0.020-inch diameter NiTiCu wire in accordance with the process of the present invention.

FIG. 4 shows the transformation sharpness, measured by differential scanning calorimetry (DSC), wherein the DSC full width peak was taken at half maximum (FWHM) for the wire samples of FIG. 3. The largest change in FWHM is observed with annealing temperatures between 400 and 450° C. These results are consistent with a narrower distribution of phase transformation potential as the defect density is reduced during recrystallization.

EXAMPLE 2

Figure 5:
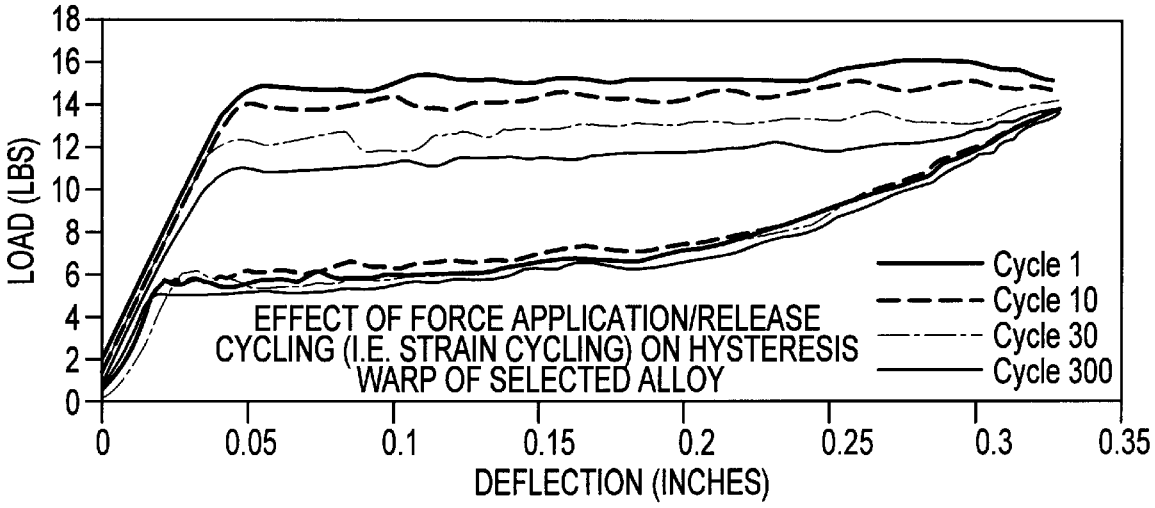
FIG. 5 is a graph of load versus deflection for a 0.020-inch diameter NiTiCu wire which has been annealed at 425° C. and is being strain cycled at a temperature of $A_f$+10° C. in accordance with the process of the present invention.

To study the effects of varying combinations of annealing temperature and strain cycling (i.e., for conditioning), samples of 0.020-inch diameter 30% cold worked NiTiCu wire were annealed at 400, 425, 450 and 475° C. for 30 minutes. The finish temperature $A_f$ was determined for each sample using DSC. Each sample was then alternately strained pseudoelastically 4 per cent and released for 300 cycles in a water bath maintained at a temperature greater than $A_f$. The water bath temperatures were selected at varying temperatures above $A_f$. A typical progression of the force/deflection response during isothermal strain cycling is presented in FIG. 5 for a wire annealed at 425° C. and a bath temperature of $A_f$+10° C.

As strain cycling progresses, the stress-induced austenite-martensite boundary decreases and the reverse martensite-austenite boundary remains constant, resulting in a reduced or collapsed hysteresis loop. The reduction in the stress-induced martensite plateau results from the formation of defects during cycling which assist the formation of preferred martensitic variants. Because only one austenitic crystal orientation exists, the reversion from aligned martensite to austenite is not greatly affected by the microstructural effects induced by strain cycling, and the resulting boundary force remains constant.

Figure 6:
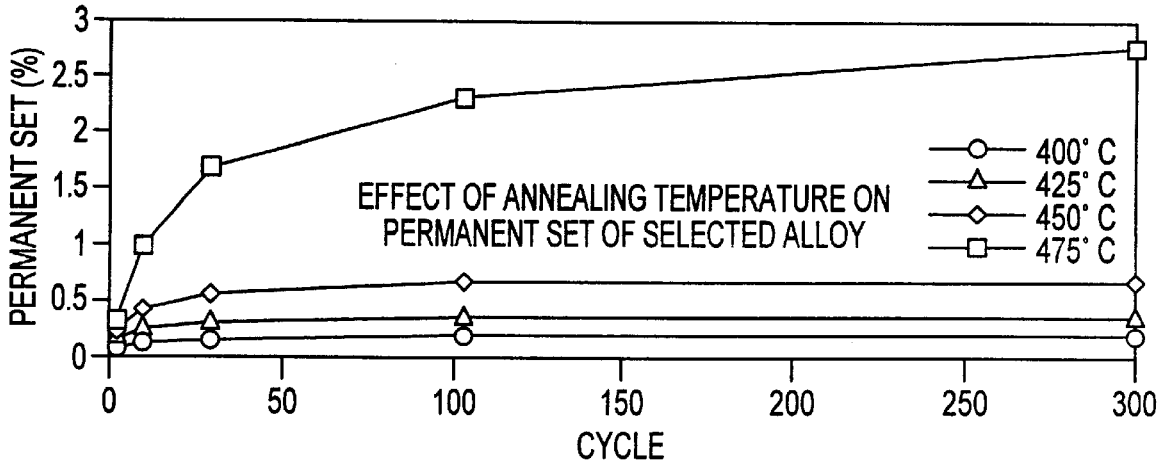
FIG. 6 is a graph of permanent set versus the number of strain cycles for 0.020-inch diameter NiTiCu wire samples that have been annealed at varying temperatures and strain cycled at a temperature equal to $A_f$+10° C. in accordance with the process of the present invention.
Figure 7:
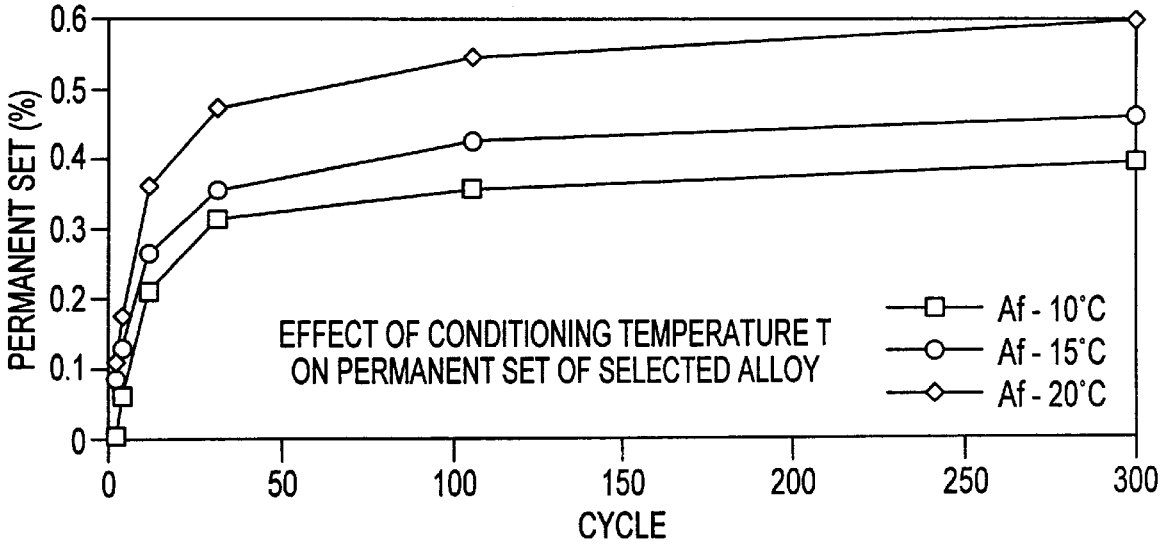
FIG. 7 is a graph of permanent set versus the number of strain cycles for 0.020-inch diameter NiTiCu wire which has been annealed at 425° C. and strain cycled at temperatures of $A_f$+10° C., $A_f$+15° C., and $A_f$+20° C. in accordance with the process of the present invention.

Increasing the annealing temperature increases the permanent set in a semi-logarithmic relationship, as shown in FIG. 6. Increasing the temperature T at which strain cycling is conducted increases the evolution of permanent set with cycling in a semi-logarithmic relationship, as shown in FIG. 7.

Examples 1 and 2 show that process parameters, including the temperature for the annealing step, the temperature for the strain cycling step, and the number of strain cycles can be selectively determined for a particular alloy composition. That is, these parameters can be particularly selected to obtain elevated and sharpened phase transformation temperatures and reduced hysteresis variability for a particular alloy composition selected.

EXAMPLE 3

Figure 8:
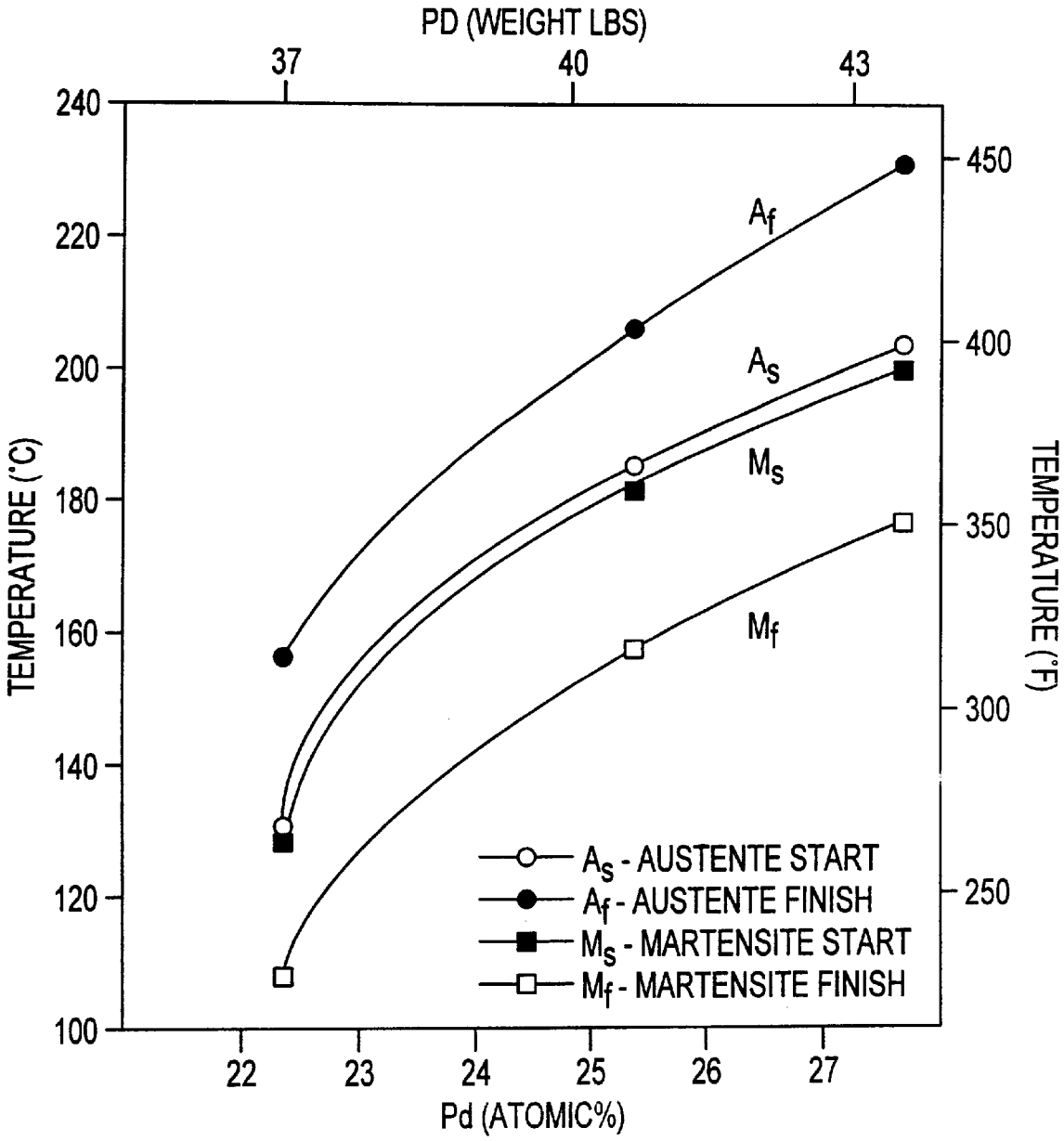
FIG. 8 is a graph showing the dependence of martensitic-austenitic and austenitic-martensitic phase transformation temperatures $A_s$, $A_f$, $M_s$, and $M_f$ on the nickel percentage in NiTi Pd.
Figure 9:
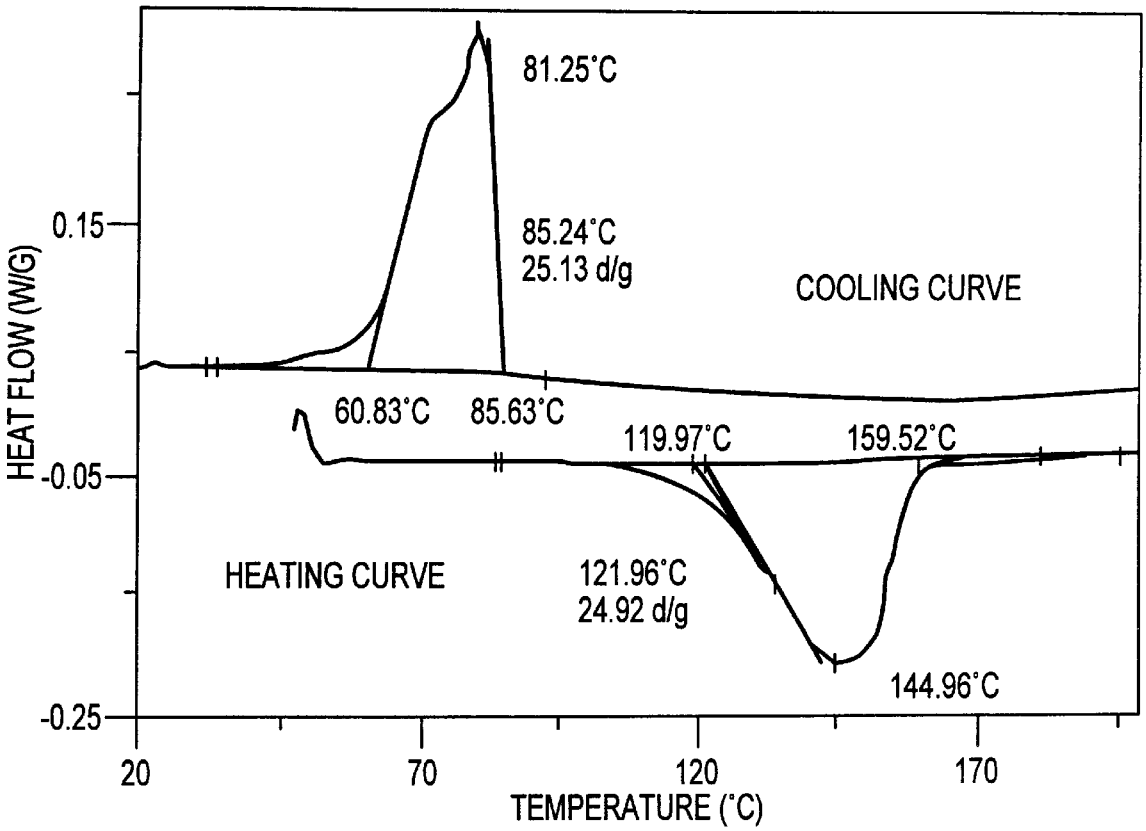
FIG. 9 is a graph of heat flow versus temperature data obtained by differential scanning calorimetry for NiTi doped with 8 atomic percent Hf.

The dependence of the martensitic-austenitic and austenitic-martensitic transformation temperatures may be very sensitive to the alloy composition. FIG. 8 shows phase transformation temperature variations of 60–80° C. for NiTi alloys containing 22 to 27 percent Hf, as determined by DSC. Adequate control of the transformation temperatures may require composition control between one tenth and one hundredth of a percent. It should be noted that it may be difficult to verify the composition with sufficient precision by chemical analysis. However, DSC and stress-strain characteristics may be utilized to verify compositions and/or phase transformation temperatures. For example, FIG. 9 illustrates the use of DSC to identify the variations in heat flow associated with phase transformations during heating and cooling of NiTi doped with 8 atomic percent Hf. The negative deflection in heat flow on the heating curve is due to absorption of energy utilized for the martensitic-austenitic transformation between $A_s$=119.7° C. and $A_f$=159.52° C. The positive deflection in heat flow on the cooling curve is due to the release of energy during the austenitic-martensitic transformation between $M_s$=85.24° C. and $M_f$=60.83° C.

EXAMPLE 4

Figure 10A:
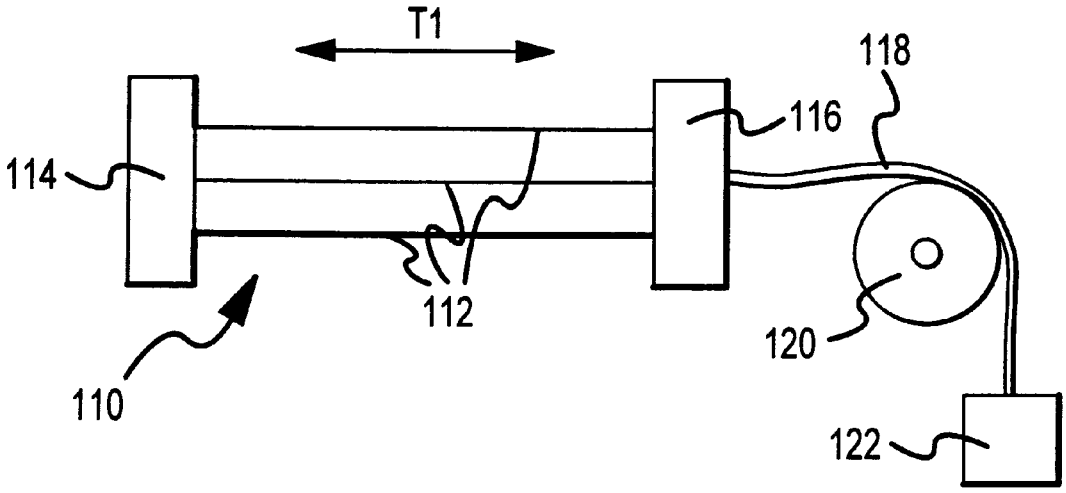
FIG. 10A is a side view of an actuator device utilizing shape memory alloy wires made in a accordance with the process of the present invention, with the device in first condition.
Figure 10B:
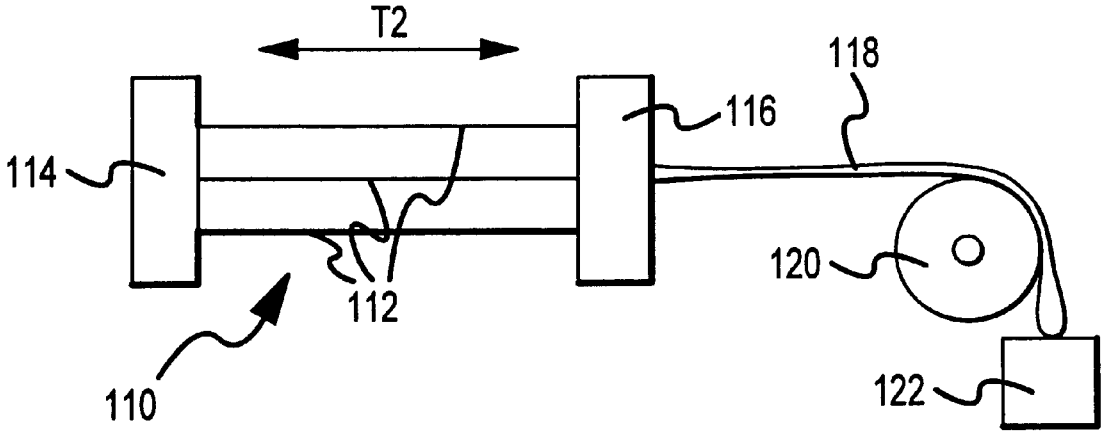
FIG. 10B is a side view of the actuator device of FIG. 10A, with the device in a second condition.

Shape memory wires may be formed from a suitable alloy and conditioned by cold-working, annealing, and isothermal strain cycling at a temperature of about 10° C. greater than $A_f$. They may then be cooled to a temperature below $M_f$. As shown in FIG. 10A, a plurality of the conditioned martensitic-phase wires 112 can then be integrated or secured between two end pieces 114 and 116 in an actuator device 110. The wires may be secured by any appropriate means such that they are under a tensional force T1 directed longitudinally along the wires. A cable 118 is secured to end piece 116 and passes over pulley 120 and suspends weight 122 in a first position. When heated to a temperature greater than Af, the wires 112 are transformed to the austenitic phase, or actuated to shrink longitudinally to a length substantially equal to their pre-strain-cycling (i.e., pre-conditioned) length. The tensional force on the wires is now T2. As the wires shrink, they pull end piece 116 toward end piece 114 and pull cable 118 to raise weight 122 to a second position, as shown in FIG. 10B.

EXAMPLE 5

Figure 11A:
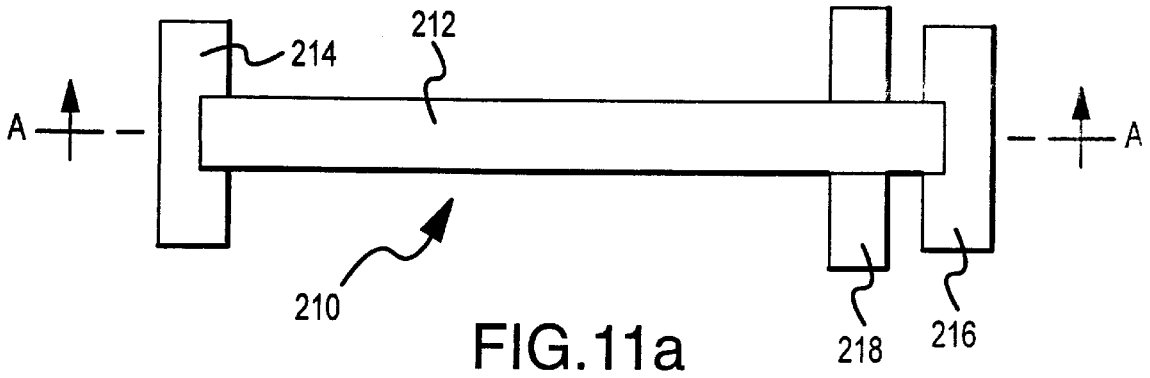
FIG. 11A is a top view of another actuator device utilizing a sheet of a shape memory alloy made in accordance with the process of the present invention, with the device in a first condition.
Figure 11B:
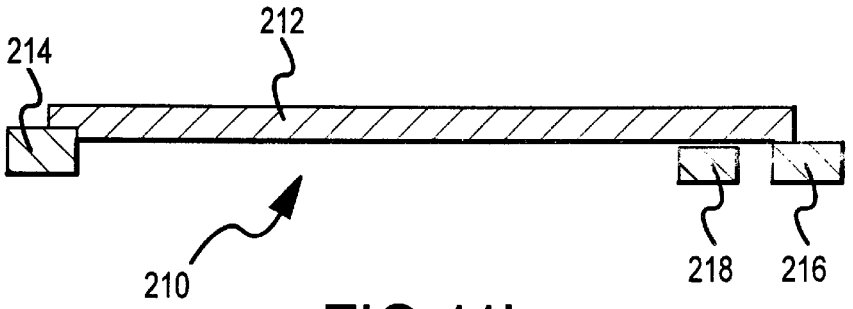
FIG. 11B is a cross sectional view of the actuator device of FIG. 11A along the line A—A.
Figure 11C:
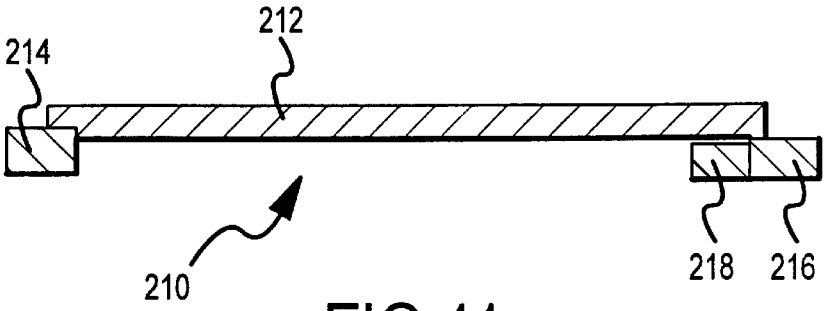
FIG. 11C is a cross sectional view of the actuator device of FIG. 11A in a second condition.

A sheet may be formed from a shape memory alloy and conditioned by cold-working, annealing, and isothermal strain cycling in accordance with the present invention. As shown in FIGS. 11A and 11B, sheet 212 of the conditioned shape memory alloy may be integrated into an actuator device 210 by engagement between end pieces 214 and 216, (e.g., such as with crimps, solders, welds, or bolts). A pressure transducer 218 is located between end pieces 214 and 216, proximate end piece 216. Upon application of heat to sheet 212, sufficient to cause a transformation of sheet 212 from the martensitic state to the austenitic state, sheet 212 is actuated to shrink to a dimension substantially equal to its pre-strain-cycling dimensions. As sheet 212 shrinks, it pulls end plate 216 closer to end plate 214, causing end plate 216 to apply pressure to transducer 218, as shown in FIG. 11C. An output from transducer 218 may be utilized in a feedback control loop to control the application of heat to sheet 212, thereby facilitating control of the degree of actuation.

The wires or sheet shown in FIGS. 10 and 11 may be heated directly, such as by passing a suitable electrical current through them, or indirectly, such by placing them in proximity with a surface which may be heated. As noted, the heat flow to the shape memory object may be controlled to obtain incremental displacement in the actuator devices. In this regard, conditioning of the shape memory alloy can be conducted to minimize permanent set and hysteresis.

The foregoing description and examples of the present invention have been presented for purposes of illustration and description. The description and examples are not intended to limit the invention to the form described. Variations and modifications commensurate with the above teachings and with the skill or knowledge of the relevant art are within the scope of the present invention.

What is claimed is:

1. A process for conditioning a shape memory alloy, comprising the steps of:

deforming a shape memory alloy in a martensitic state; and heating said shape memory alloy to a temperature greater than a finish martensitic-austenitic transformation temperature $A_f$ of said shape memory alloy; and applying and releasing a conditioning force to said shape memory alloy while continuing said heating to maintain the shape memory alloy at a temperature greater than said temperature $A_f$, wherein at least a portion of said shape memory alloy undergoes a phase transformation from an austenite phase to a martensite phase during said applying and releasing step.

2. A process as claimed in claim 1, wherein said shape memory alloy is selected from the group consisting of: NiTiCu, CuZnAl, CuAlNi, NiTiFe, NiTi, CuAlNiTiMn, TiNiPd, and TiNiPt.

3. A process as claimed in claim 1, wherein said elevated temperature is at least about 5° C. greater than said $A_f$.

4. A process as claimed in claim 1, wherein said applying and releasing step is successively repeated for a predetermined number of cycles while maintaining the shape memory alloy at an elevated temperature above $A_f$.

5. A process as claimed in claim 4, wherein said predetermined number of cycles is at least about 50.

6. A process as claimed in claim 1, further comprising:

cold-working said shape memory alloy prior to said deforming step.

7. A process as claimed in claim 6, wherein the shape memory alloy is cold-worked between about 20 and 45% during said cold-working step.

8. A process as claimed in claim 6, further comprising:

annealing the shape memory alloy following said cold-working step and prior to said deforming step.

9. A process as claimed in claim 8, wherein between about 3% to about 8% cold-working of said shape memory alloy is maintained upon completion of the annealing step.

10. A process as claimed in claim 8, wherein said annealing step is completed at a temperature of between 425° C. and about 475° C.

11. A process as claimed in claim 1, wherein said deforming step comprises the application of a deformation force to the shape memory alloy, and wherein the application of the conditioning force during said applying and releasing step at least partially mimics the application of the deformation force during said deforming step.

12. A process as claimed in claim 11, wherein the deformation force is applied to a predetermined first degree, and wherein conditioning force is applied to a predetermined second degree that is less than said first predetermined degree.

13. A process as claimed in claim 1, wherein said elevated temperature is maintained substantially constant during said applying and releasing step.

14. A process as claimed in claim 13, wherein said applying and releasing step comprises the successive application and release of said conditioning force to the shape memory alloy for at least about 100 cycles.

15. A process as claimed in claim 1, wherein after said applying and repeating step the process further comprises:

cooling said shape memory alloy; and, integrating said shape memory alloy into an application mechanism, wherein said shape memory alloy of said application mechanism is selectively actuatable upon heating to a temperature above $A_f$.

16. A process as claimed in claim 1, wherein said temperature is less than a maximum temperature at which an austenitic to martensitic phase transformation in said shape memory alloy is inducible by the application of a force.

17. A process for conditioning a shape memory alloy selected from the group consisting of CuAl-containing alloys and NiTi-containing alloys, comprising the steps of:

coldworking a shape memory alloy in a martensitic state;

annealing said shape memory alloy;

heating said shape memory alloy to a temperature greater than a finish martensitic-austenitic transformation temperature $A_f$ of said shape memory alloy;

applying and releasing a conditioning force to said shape memory alloy while continuing said heating to maintain the shape memory alloy at a temperature above $A_f$, wherein application of said conditioning force deforms said shape memory alloy pseudoelastically and at least a portion of said shape memory alloy undergoes a phase transformation from an austenitic phase to a martensitic phase; and repeating said applying and releasing step.

18. A process as claimed in claim 17, wherein said cold-working step comprises cold-working said shape memory alloy between about 20% and about 45%.

19. A process as claimed in claim 18, wherein said cold-working step comprises cold-working said shape memory alloy about 30%.

20. A process as claimed in claim 18, wherein in said annealing step said cold-working is reduced to between about 3% and 8%.

21. A process as claimed in claim 20, wherein said repeating step is conducted for at least about 50 cycles.

22. A process as claimed in claim 17 wherein, said annealing step comprises:

maintaining said shape memory alloy at a predetermined annealing temperature for a predetermined annealing time, said predetermined annealing temperature and predetermined annealing time being selected to alter phase transformation temperatures of said shape memory alloy.

23. A process as claimed in claim 22, wherein said predetermined annealing temperature is between about 400° C. and 500° C.

24. A process as claimed in claim 17, further comprising:

deforming said shape memory alloy in a martensitic state from a predeformation shape to a set shape, wherein said shape memory alloy substantially returns to said predeformation shape during said releasing step.

25. A process as claimed in claim 24, further comprising:

cooling said shape memory alloy; and fabricating a plurality of components from said shape memory alloy, wherein each of said components is selectively actuatable upon heating to a temperature above $A_f$.

26. A process as claimed in claim 17, wherein said temperature is less than a maximum temperature of which an austenitic to martensitic phase transformation in said shape memory alloy is inducible by the application of a force.

27. A method for processing a shape memory alloy, the process comprising of steps:

deforming a shape memory alloy in a martensitic state;

heating said shape memory alloy to a temperature greater than a finish martensitic-austenitic transformation temperature $A_f$ of said shape memory alloy; and applying a conditioning force to said shape memory alloy and releasing said conditioning force while continuing said heating to maintain the shape memory alloy at a temperature greater said temperature $A_f$, wherein upon application of said conditioning force at least a portion of said shape memory alloy undergoes a phase transformation from an austenitic phase to a martensitic phase;

cooling said shape memory alloy; and integrating said shape memory alloy into an application mechanism, wherein said shape memory alloy of said application mechanism is selectively actuatable upon heating to a temperature above $A_f$.

28. A process as claimed in claim 27, wherein said temperature is less than a maximum temperature at which an austenitic to martensitic phase transformation in said shape memory alloy is inducible by the application of a force.

29. A process as claimed in claim 28, further comprising the steps of:

cold-working said shape memory alloy between about 20% and 45%; and annealing said shape memory alloy following said cold-working step, wherein said cold-working is reduced to between about 3% and 8%.

30. A process as claimed in claim 28, wherein in said deforming step said shape memory alloy is deformed from a predeformation shape to a set shape, and wherein said shape memory alloy at least partially returns to said predeformation shape upon release of said conditioning force.

31. A process as claimed in claim 27, wherein said applying and releasing step is repeated at least about 50 cycles.

32. A process as claimed in claim 27, wherein said deforming step comprises the application of a deformation force to the shape memory alloy, and wherein the application of the conditioning force during said applying and releasing step at least partially mimics the application of the deformation force during said deforming step.

33. A process as claimed in claim 32, wherein the deformation force is applied to a predetermined first degree, and wherein conditioning force is applied to a predetermined second degree that is less than said first predetermined degree.

* * * * *